US005467843A

United States Patent [19]

Esch et al.

[11] Patent Number: 5,467,843

[45] Date of Patent: Nov. 21, 1995

[54] ARRANGEMENT FOR GUIDING LUBRICATING OIL IN AN INTERNAL-COMBUSTION ENGINE

[75] Inventors: Hans-Joachim Esch, Heimsheim; Winfried Distelrath, Stuttgart; Kurt Trieb, Markgroeningen, all of Germany

[73] Assignee: Dr. Ing. h.c.F. Porsche AG, Germany

[21] Appl. No.: 274,189

[22] Filed: Jul. 12, 1994

[30] Foreign Application Priority Data

Jul. 12, 1993 [DE] Germany ..... 43 23 220.5

[51] Int. Cl.[6] ..... F01M 1/04

[52] U.S. Cl. ..... 184/6.5; 184/6.23; 123/196 R; 123/192.2

[58] Field of Search ..... 184/6.5, 6.13, 184/6.23; 123/196 R, 196 A, 198 DA, 192.2

[56] References Cited

U.S. PATENT DOCUMENTS

| | | | |
|---|---|---|---|
| 3,687,231 | 8/1972 | Scheiterlein | 123/196 R |
| 4,509,474 | 4/1985 | Schmuck | 123/192.2 |
| 4,703,724 | 11/1987 | Candea et al. | 123/192.2 |
| 5,038,890 | 8/1991 | Tanaka et al. | 123/196 R |

FOREIGN PATENT DOCUMENTS

| | | | |
|---|---|---|---|
| 333548 | 11/1976 | Austria . | |
| 0291358 | 11/1988 | European Pat. Off. | 123/198 DA |
| 3935789 | 5/1991 | Germany | 184/6.23 |
| 4204522 | 4/1993 | Germany . | |
| 59-054718 | 3/1984 | Japan . | |

*Primary Examiner*—Thomas E. Denion
*Attorney, Agent, or Firm*—Evenson, McKeown, Edwards & Lenahan

[57] ABSTRACT

An internal-combustion engine which has an intermediate shaft extending in parallel to the crankshaft, comprises a basin which is arranged between the shafts and which guides lubricating oil released by the crankshaft drive into an oil sump. This basin has struts which project downwardly away and which surround the intermediate shaft in such a manner that it is secured against the admission of lubricating oil of the crankshaft drive. As a result, this lubricating oil arrives in an oil tank in a largely unfoamed state.

20 Claims, 6 Drawing Sheets

ARRANGEMENT FOR GUIDING LUBRICATING OIL IN AN INTERNAL-COMBUSTION ENGINE

BACKGROUND AND SUMMARY OF THE INVENTION

This invention relates to an arrangement for guiding lubricating oil in an internal-combustion engine comprising a basin which is arranged between an engine crankshaft drive and an oil sump and has at least one drain opening, and an intermediate shaft which rotates in parallel to the crankshaft and is surrounded at least partially by two struts projecting away from the basin.

From German Patent Document DE-42 04 522 C1, an arrangement in an internal-combustion engine is known which has a basin for letting off lubricating oil which covers the crankshaft drive in the direction of the oil sump. Approximately in the center below the crankshaft, the basin which extends partially along the violin-shaped connecting rod contour has an oil drain opening which acts as an oil deflector. This oil drain opening leads into a damping chamber for the gas pulses caused by the piston movement, this damping chamber comprising another drain opening which is arranged below the oil drain opening and is laterally offset with respect to the oil drain opening. The lubricating oil which is thrown off the crankshaft drive flows through this additional drain opening into the oil sump. A differential shaft may rotate in this damping chamber which is enclosed at least partially by two struts projecting away from the basin. It is disadvantageous in this case that the oil is foamed as a result of the contact with the rotating differential shaft and arrives in the oil sump in this condition.

It is an object of the invention to develop an arrangement of this type for guiding lubricating oil in an internal-combustion engine arranged between the crankshaft drive and the oil sump in such a manner that the lubricating oil released by the crankshaft drive reaches the oil tank in a largely unfoamed manner.

This object is achieved by the present invention by providing an arrangement for guiding oil in an internal-combustion engine comprising a basin which is arranged between an engine crankshaft drive and an oil sump and has at least one drain opening, and an intermediate shaft which rotates in parallel to the crankshaft and is surrounded at least partially by two struts projecting away from the basin, wherein the struts form, together with the basin, a profile which receives the intermediate shaft and which is closed with respect to the crankshaft drive.

When, in the case of an internal-combustion engine of the above-mentioned type, the projecting struts of the basin form a profile which accommodates the intermediate shaft and is closed with respect to the crankshaft drive, the intermediate shaft is shut off with respect to the entering of lubricating oil of the crankshaft drive. This lubricating oil therefore reaches the oil sump while bypassing the rotating intermediate shaft and is not foamed by the rotation.

In an advantageous development, the bottom of the basin is provided in the area of the violin-shaped connecting rod contour with curved segments which follow them and which extend, by means of the curvature, closely adjacent to this contour and therefore leave only a small gap in which oil can be mixed with air. An arrangement of two drain openings which are situated in series with respect to one another with respect to the rotating direction of the crankshaft and behind the profile ensures a reliable discharge of the lubricating oil.

The amount of oil taken from the crankshaft drive and therefore not rotating with it can be increased if roof-type shaped-out areas are arranged behind the drain openings which point in the direction of the crankshaft, are provided with scraper lips and extend directly to the violin-shaped connecting rod contour. These may bound drain ducts which contain the drain openings and guide the taken-up lubricating oil into the oil sump.

In order to provide a further improvement by also taking up the lubricating oil thrown off the counterweights arranged adjacent to the connecting rods on the crankshaft, at least adjacent to one shaped-out area, a scraper may be arranged which extends directly to the counterweight contour.

For the complete shutting-off of the intermediate shaft, the ends of the struts which are situated at a distance from the bottom of the basin, provided for example with elastic seals, may rest against wall sections of the internal-combustion engine in such a manner that they form, together with the profile, a closed volume which extends along the intermediate shaft and accommodates it. These wall sections may be lateral walls of a crankcase which extend downward beyond the crankshaft or walls of an oil tank which is flanged to the crankcase and is constructed as an oil sump. In both cases, one wall section may have an outlet opening for lubricating oil. The oil can therefore be drained which has collected in the shaft formed between one strut and the drain ducts as well as this wall section In the former case, when there is dry sump lubrication, the take-in point of the oil pump which delivers the oil into an oil receptacle constructed as a tank may be situated in this outlet opening.

A surrounding flange of the bottom which is situated on the outside may be situated in a horizontal plane arranged between the crankshaft and the intermediate shaft, the flange, which is also provided with elastic seals, being supported on the wall sections. These seals may be placed, for example, as a sealing ring which has a circular cross-section, in corresponding grooves of the flange or of the struts.

In another embodiment, they may be provided with a sealing lip which extends in a curved manner when resting against the corresponding wall section. By means of the sealing lips, positional tolerances of the bottom or of the struts with respect to the wall sections can easily be compensated. An appropriately selected direction of the curvature of the sealing lips provides that, on the one hand, no oil can emerge from the shaft at points which are not provided for this purpose; and, on the other hand, a tunnel which is arranged on the opposite side of the intermediate shaft is secured against an admission of oil from the crankshaft drive, and oil which may be situated in it can flow off in a groove of the volume receiving the intermediate shaft.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
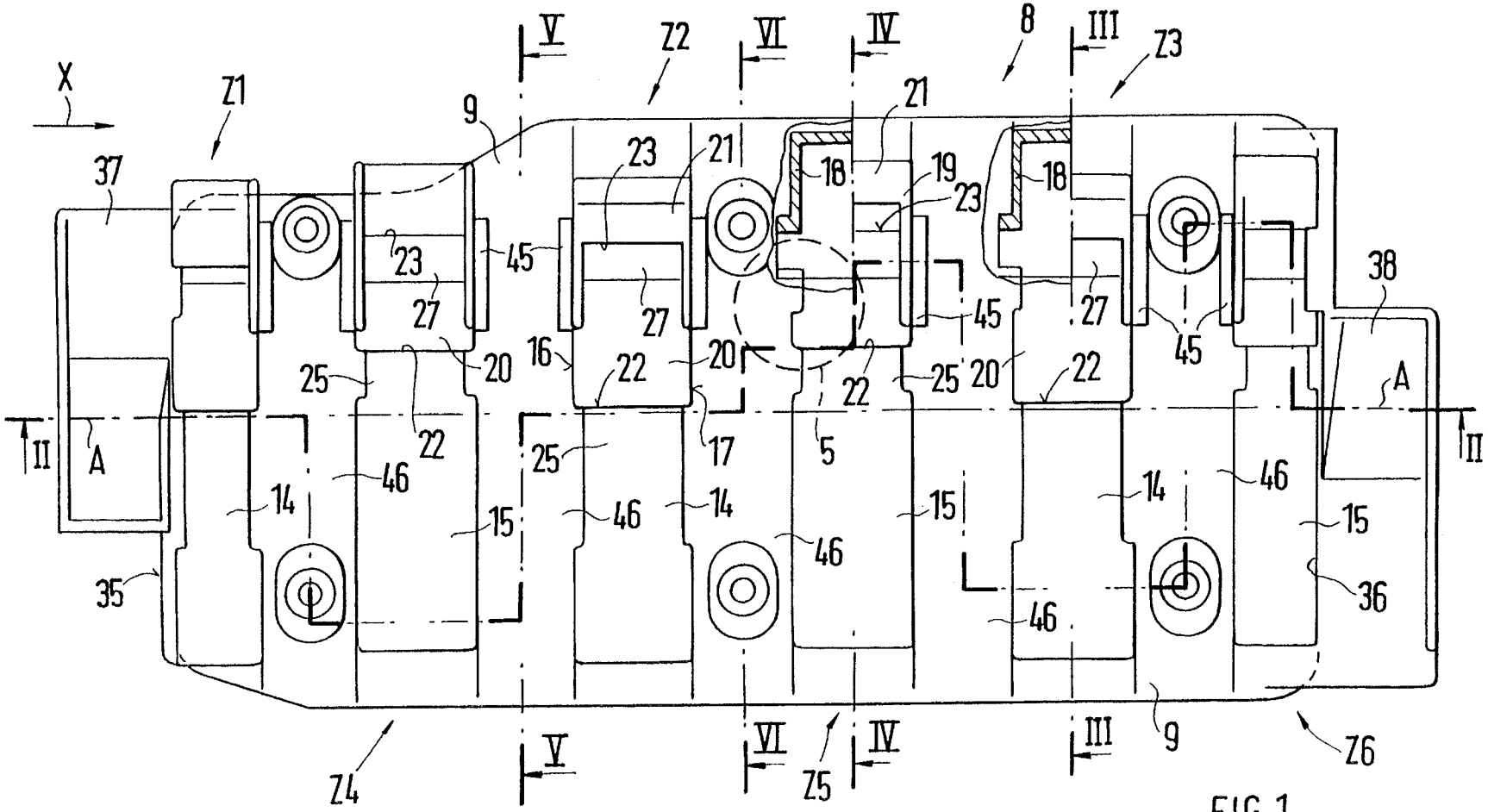
FIG. 1 is a partially broken top schematic view of an arrangement for guiding oil in an internal-combustion engine constructed according to a preferred embodiment of the invention.
Figure 2:
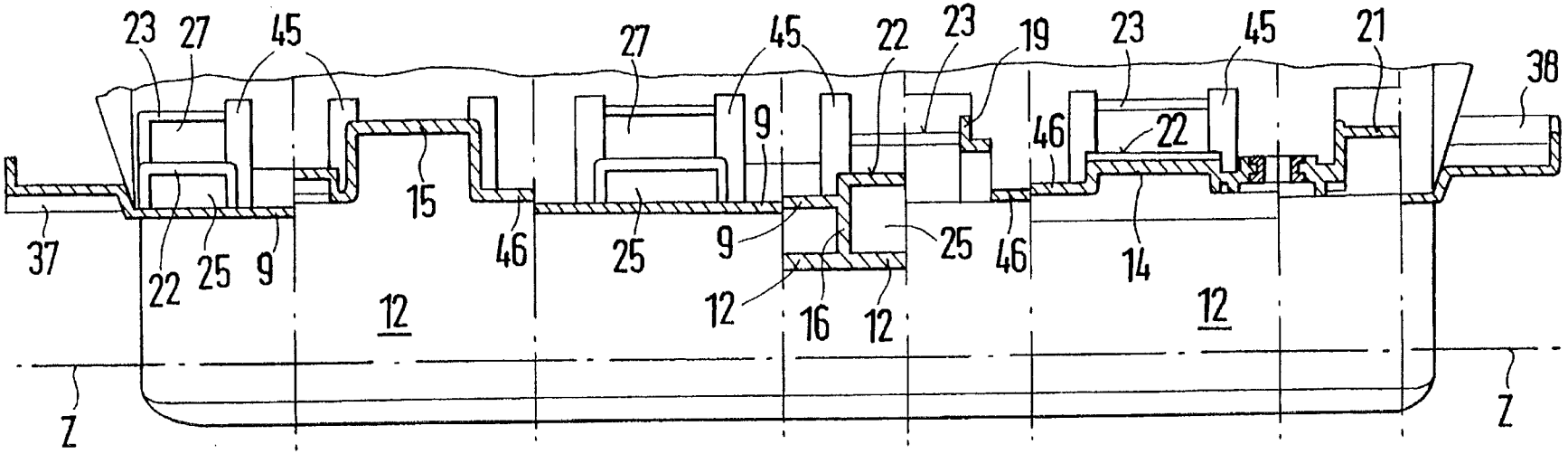
FIG. 2 is a sectional view along Line II—II according to FIG. 1.

A two-bank internal-combustion engine with a V-angle of 180°, which is not shown in detail, has a crankshaft drive comprising a crankshaft 1 which can be rotated about an axis A—A in the direction of the shown arrow. In the center below the crankshaft 1, an intermediate shaft 2 rotates about its axis Z—Z. A crankcase is divided into halves perpendicularly in a plane E—E which contains the axes A—A and Z—Z. Below the crankshaft drive the halves of wall sections 3 and 4 extend in a V-shape with respect to one another, and a single drain opening 5 is arranged in section 4.

The crankshaft drive has conventional counterweights which are situated adjacent to connecting rod journals and which, in the case of a rotation, result in a counterweight contour K. The cylinders Z1, Z2, Z3 assigned to a cylinder bank produce by means of their connecting rod on the crankshaft drive a first violin-shaped connecting rod contour 6; the cylinders Z4, Z5 and Z6 assigned to the other cylinder bank produce a second violin-shaped connecting rod contour 7.

Between the axes A—A and Z—Z, a horizontal plane H—H extends perpendicularly to the plane E—E. Essentially along this plane H—H, a basin 8 extends along the whole length of the crankshaft 1 and comprises a bottom 9 and a flange 10 situated on the exterior.

Two struts 11, 12 extend away from the basin 8 symmetrically with respect to plane E—E and form, together with a piece of the bottom 9, a profile 13 which is closed with respect to the crankshaft drive and which encloses the intermediate shaft 2 in a U-shaped manner.

Below the connecting rod journal of the crankshaft 1, the bottom 9 comprises segments 14 and 15 which, with respect to the rotating direction of the crankshaft 1, are situated in front of the plane E—E and which in a curved manner follow the violin-shaped connecting rod contours 6 and 7 in a closely adjacent manner.

Two roof-type shaped-out areas 20 and 21, which are each provided with lateral walls 16, 17 and 18, 19 adjoin the segments 14, 15 and are situated in series in the rotating direction behind the plane E—E. These shaped-out areas 20 and 21 comprise scraper lips 22 and 23 which are each tilted out in the direction of the crankshaft drive, point against the rotating direction of the crankshaft 1 and extend into the direct proximity of the violin-shaped connecting rod contours 6 and 7.

Between the shaped-out area 20 and the strut 12, a drain duct 25 is formed which has a first drain opening 24; between the shaped-out area 21 and the shaped-out area 20, a drain duct 27 is formed which has a second drain opening 26. Below these drain openings 24 and 26, a shaft 28 is formed which is bounded by one strut 12 and wall section 4 and which extends in parallel along the whole length of the crankshaft 1.

On the opposite side of plane E—E, a closed tunnel 29 is formed between the bottom 9 or its segments 14, 15, the other strut 11 and the wall section 3.

Ends 30, 31 of struts 11, 12 situated at a distance from the bottom 9 rest against the wall sections 3, 4 by means of elastic devices. Additional elastic devices are arranged between the flange 10 and these wall sections 3, 4.

Figure 3:
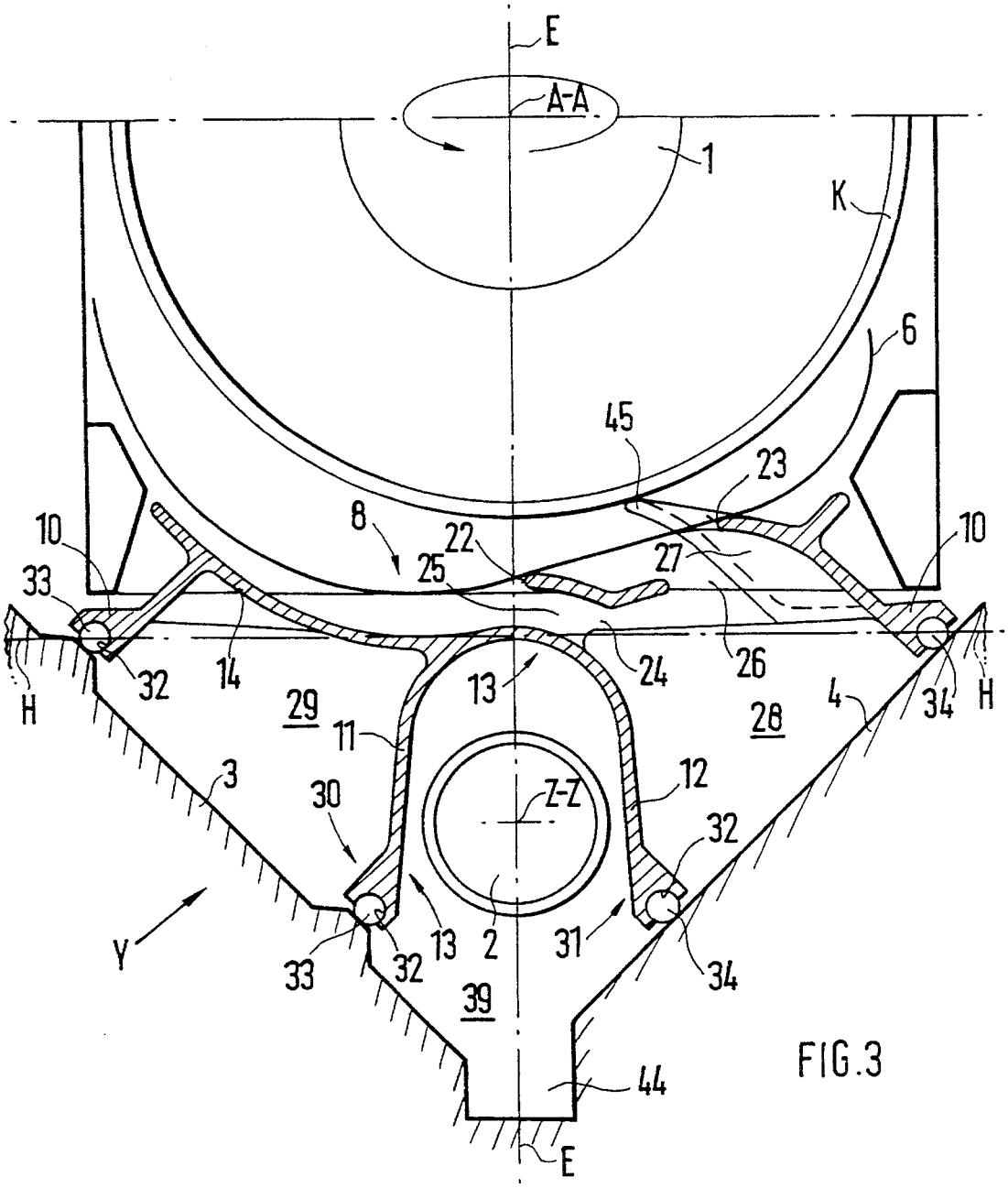
FIG. 3 is a sectional view along Line III—III according to FIG. 1.
Figure 4:
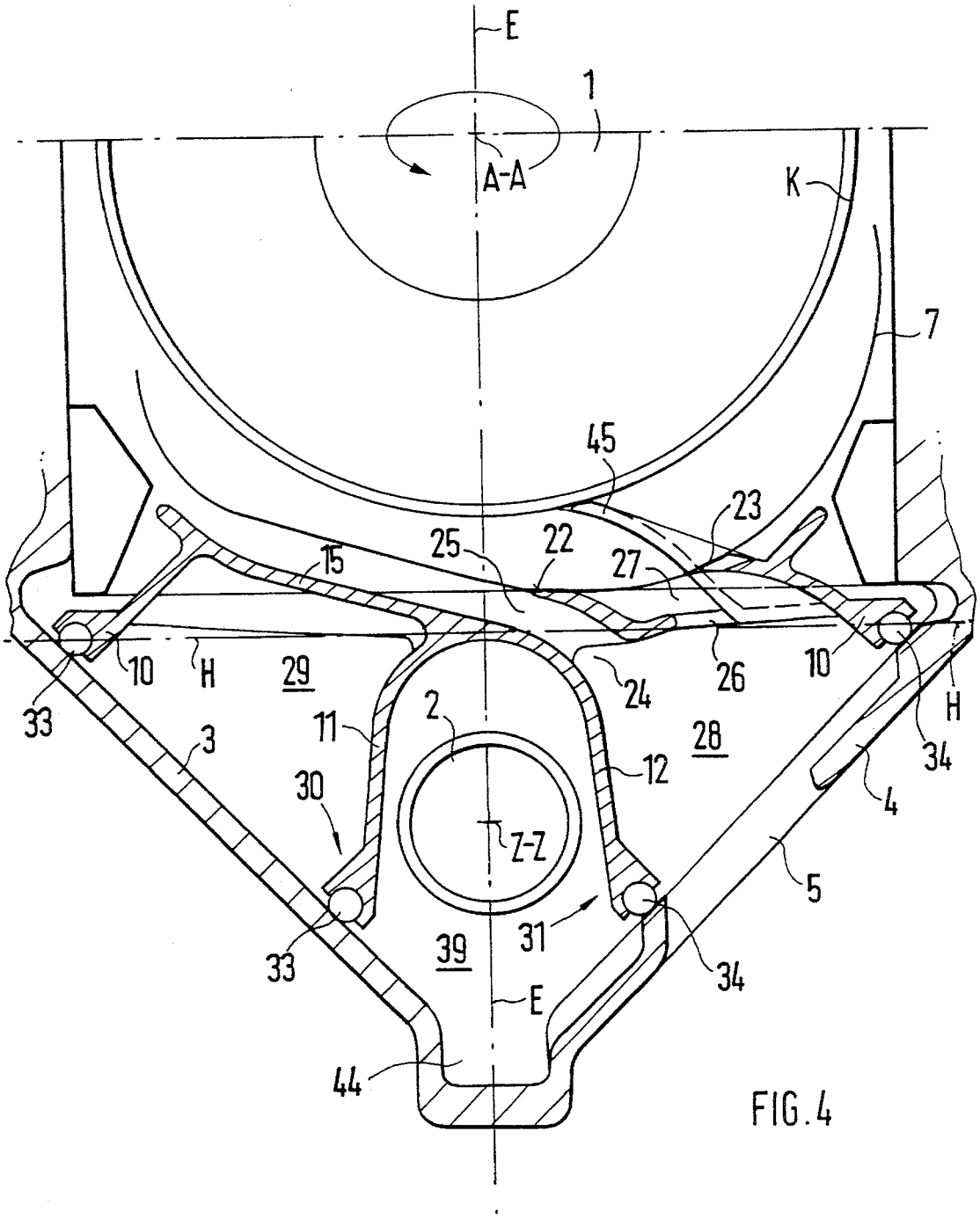
FIG. 4 is a sectional view along Line IV—IV according to FIG. 1.
Figure 7:
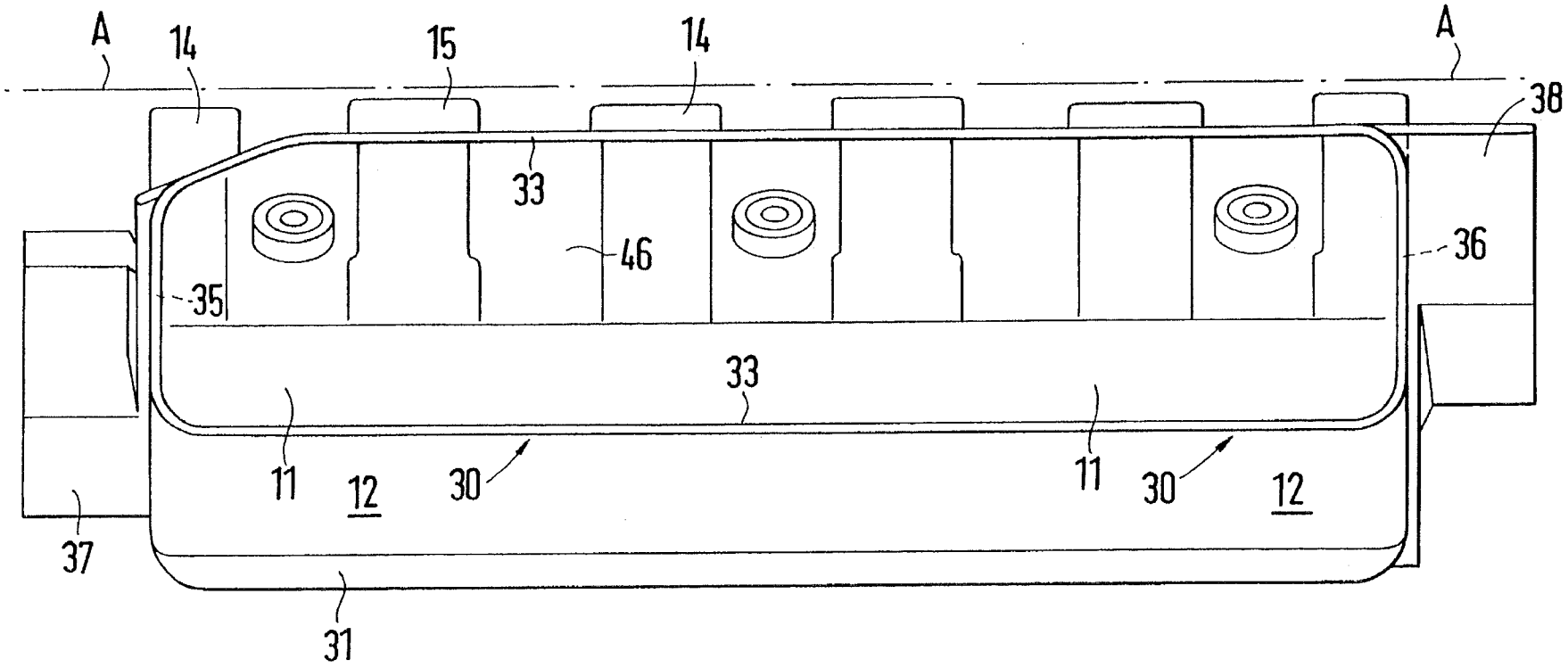
FIG. 7 is a view in the direction of the arrow Y according to FIG. 3.

According to FIG. 3, these devices are constructed as sealing rings 33, 34 which are placed in grooves 32 and which are constructed in a surrounding manner according to FIG. 7. In this case, the basin 8 is bounded on the end by walls 35, 36 which extend from the bottom 9 to close to the wall sections 3 and 4 and rest against these wall sections 3 and 4 by means of the elastic devices. In the area of the respective end-side bearings of the crankshaft 1, the basin 8 has roofs 37, 38 which extend beyond these walls 35, 36. FIGS. 3 and 4 show that the intermediate shaft 2 rotates in a volume 39 which is closed in the radial direction.

Figure 5:
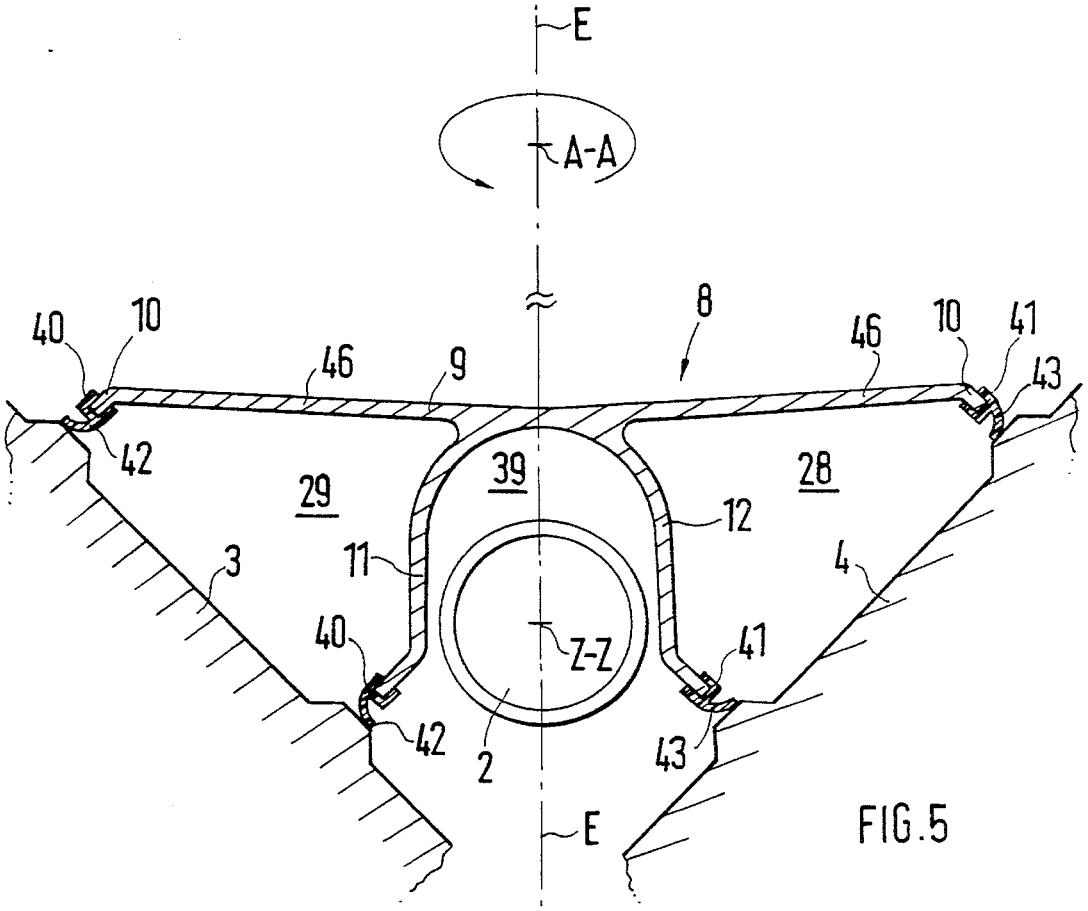
FIG. 5 is a sectional view along Line V—V according to a variant of FIG. 1.
Figure 6:
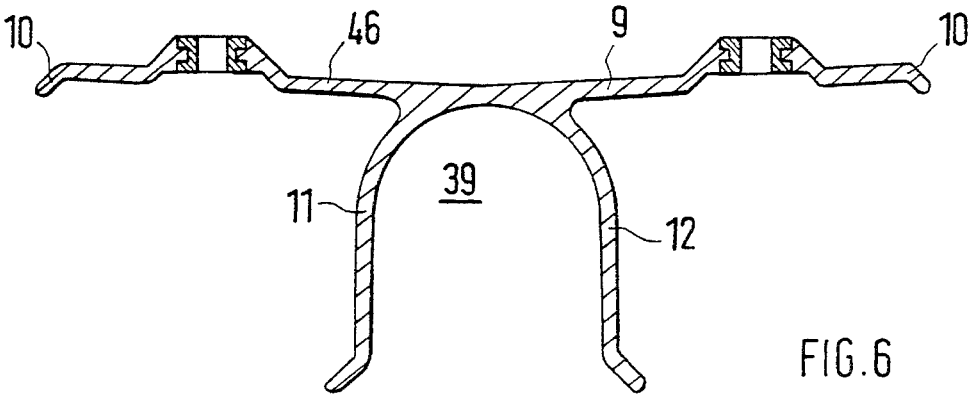
FIG. 6 is a sectional view along Line VI—VI according to FIG. 1.

In a variant according to FIG. 5, the elastic devices are formed of seals 40, 41 which are fitted on and which are each provided with a sealing lip 42, 43. In the condition in which they are installed in the internal-combustion engine, these sealing lips 42, 43 rest against the wall sections 3, 4 in such a curved manner that, on the one hand, the shaft 28 is secured against the emerging of oil and, on the other hand, the tunnel 29 is sealed off on the flange 10 against the admission of oil, and on the strut 12, a flowing-off of oil which may be situated in the tunnel 29 may be possible into a groove 44 of the volume 39. FIG. 5 illustrates that in these case the sealing lips 42, 43 of the struts 11, 12 are curved forward in the rotating direction of the crankshaft 1 and those of the flange 10 are curved forward in the corresponding opposite direction.

A scraper 45 is assigned to each counterweight on the crankshaft 1 which is arranged on the lateral walls 18 and 19 of the additional shaped-out area 21 and which extends into the direct proximity of the counterweight contour K.

In the operation of the internal-combustion engine, the lubricating oil released by the crankshaft drive is received in the area of the connecting rods by the scraper lips 22 and 23 and is guided by way of drain ducts 25 and 27 into the shaft 28. In the area of the counterweights, the oil is gripped by the scrapers 45 and is supplied to the shaft 28 by way of the drain duct 27. The lubricating oil released by the bearings of the crankshaft 1 situated between the segments 14, 15 drips onto essentially flatly designed areas 46 of the bottom 9 and flows to the shaft 28 by way of the drain duct 25. In this shaft 28, the oil flows to the drain opening 5 which is situated approximately in the center with respect to the longitudinal course of the basin 8. All lubricating oil coming from the crankshaft drive is therefore discharged while bypassing the intermediate shaft 2. The path to be covered by the oil on the bottom 9, through the drain openings 24, 26 and in the shaft 28 to the outlet opening 5 permits an extensive degasification of the lubricating oil.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for guiding oil in an internal-combustion engine, comprising:

a basin which is arranged between an engine crankshaft drive and an oil sump and has at least one drain opening between the engine crankshaft drive and the oil sump, and an intermediate shaft which rotates in parallel to the crankshaft and is surrounded at least partially by two struts projecting away from the basin, wherein the struts form, together with the basin, a profile which receives the intermediate shaft and which is closed with respect to the crankshaft drive.

2. An arrangement according to claim 1, wherein a bottom of the basin has a first and a second drain opening which are arranged behind one another in the rotating direction of the crankshaft and adjacent to the profile.

3. An arrangement according to claim 2, wherein the bottom has curved segments in the area of a violin-shaped connecting rod contour, which curved segments follow the contour and are situated in front of the drain openings.

4. An arrangement according to claim 3, wherein the basin has at least one scraper lip behind the respective first and second drain opening, which points in the direction of the crankshaft drive and against its rotating direction and which extends to close to the violin-shaped connecting rod contour.

5. An arrangement according to claim 4, wherein the scraper lip is arranged on a roof-type shaped-out area of the basin provided with lateral walls, a drain duct which has the first drain opening being constructed between one strut and one shaped-out area.

6. An arrangement according to claim 5, wherein another drain duct is formed which has the second drain opening between the shaped-out area and another shaped-out area provided with a scraper lip.

7. An arrangement according to claim 6, wherein the at least one scraper on one of the shaped-out areas is arranged which extends to close to a counterweight contour of the crankshaft drive.

8. An arrangement according to claim 2, wherein ends of the struts, which are situated at a distance from the bottom of basin, rest against wall sections of the internal-combustion engine by means of elastic devices in such a manner that these wall sections, together with the profile, form a closed volume which extends along the intermediate shaft and receives it.

9. An arrangement according to claim 8, wherein the bottom has a flange which is situated on the outside in a horizontal plane arranged between the intermediate shaft and the crankshaft, which flange rests against the wall sections by means of elastic devices.

10. An arrangement according to claim 6, wherein a shaft which receives lubricating oil is formed between one of the struts and the drain ducts as well as the wall section situated adjacent to them, which shaft has a single drain opening which is arranged in the wall section.

11. An arrangement according to claim 9, wherein the elastic devices are formed of seals which are provided with sealing lips which are curved in the condition in which they rest against the wall sections.

12. An arrangement according to claim 11, wherein the sealing lips of the struts are curved forward in the rotating direction of the crankshaft and those of the flange are curved forward in the respective opposite direction.

13. An arrangement according to claim 6, wherein the at least one scraper on one of the shaped-out areas is arranged which extends to close to a counterweight contour of the crankshaft drive.

14. An arrangement according to claim 9, wherein a shaft which receives lubricating oil is formed between one of the struts and the drain ducts as well as the wall section situated adjacent to them, which shaft has a single drain opening which is arranged in the wall section.

15. An arrangement for guiding oil in an internal-combustion engine, comprising:

a basin which is arranged between an engine crankshaft drive and an oil sump and has at least one drain opening, and an intermediate shaft which rotates in parallel to the crankshaft and is surrounded at least partially by two struts projecting away from the basin, wherein the struts form, together with the basin, a profile which receives the intermediate shaft and which is closed with respect to the crankshaft drive, and wherein a bottom of the basin has a first and a second drain opening which are arranged behind one another in the rotating direction of the crankshaft and adjacent to the profile, and wherein the bottom has curved segments in the area of a violin-shaped connecting rod contour, which curved segments follow the contour and are situated in front of the drain openings, and wherein the basin has at least one scraper lip behind the respective first and second drain opening, which points in the direction of the crankshaft drive and against its rotating direction and which extends to close to the violin-shaped connecting rod contour, and wherein the scraper lip is arranged on a roof-type shaped-out area of the basin provided with lateral walls, a drain duct which has the first drain opening being constructed between one strut and one shaped-out area.

16. An arrangement according to claim 15, wherein another drain duct is formed which has the second drain opening between the shaped-out area and another shaped-out area provided with a scraper lip.

17. An arrangement according to claim 16, wherein the at least one scraper on one of the shaped-out areas is arranged which extends to close to a counterweight contour of the crankshaft drive.

18. An arrangement for guiding oil in an internal-combustion engine, comprising:

a basin which is arranged between an engine crankshaft drive and an oil sump and has at least one drain opening, and an intermediate shaft which rotates in parallel to the crankshaft and is surrounded at least partially by two struts projecting away from the basin, wherein the struts form, together with the basin, a profile which receives the intermediate shaft and which is closed with respect to the crankshaft drive, and wherein the ends of the struts, which are situated at a distance from the bottom of the basin, rest against wall sections of the internal-combustion engine by means of elastic devices in such a manner that these wall sections, together with the profile, form a closed volume which extends along the intermediate shaft and receives it.

19. An arrangement according to claim 18, wherein the bottom has a flange which is situated on the outside in a horizontal plane arranged between the intermediate shaft and the crankshaft, which flange rests against the wall sections by means of elastic devices.

20. An arrangement according to claim 16, wherein a shaft which receives lubricating oil is formed between one of the struts and the drain ducts as well as the wall section situated adjacent to them, which shaft has a single drain opening which is arranged in the wall section.

* * * * *